United States Patent [19]

Oshinsky et al.

[11] 4,143,701

[45] Mar. 13, 1979

[54] CORE ASSEMBLY IN A COUPLER FOR A RAILWAY VEHICLE

[75] Inventors: Frank W. Oshinsky, McKeesport; Thomas R. Brown, Sr., Pittsburgh, both of Pa.

[73] Assignee: McConway & Torley Corporation, Pittsburgh, Pa.

[21] Appl. No.: 815,325

[22] Filed: Jul. 13, 1977

[51] Int. Cl.[2] ..... B22C 9/10; B22C 9/24

[52] U.S. Cl. ..... 164/368; 249/145

[58] Field of Search ..... 164/365, 368, 369, 370, 164/364, 366, 367; 213/152, 153, 154; 249/145, 146

[56] References Cited

U.S. PATENT DOCUMENTS

| | | | |
|---|---|---|---|
| 536,342 | 3/1895 | Harrington | 249/145 |
| 3,264,693 | 8/1966 | Flitz | 164/368 |

*Primary Examiner*—Roy Lake
*Assistant Examiner*—John S. Brown
*Attorney, Agent, or Firm*—Thomas H. Murray; Clifford A. Poff

[57] ABSTRACT

A novel core assembly is used in a sand mold for casting a hollow section in a coupler head extending beyond a horn line into a coupler shank of a coupler for a railway vehicle. The core assembly includes head and shank core members having face surfaces each including a recess surface and a projected surface arranged such that the recess surface in the head core receives the projected surface in the shank core. In a similar way, the recess surface in the shank core receives the projected surface in the head core to maintain the head and shank cores in an aligned abutting relation while supported in the sand mold. The face surfaces extend transversely to the coupler shank along a parting line spaced rearwardly of the plane containing the horn line of the coupler. The face surfaces are further characterized by a conically-shaped projection extending from one core member into a conically-shaped opening in the other core member to mechanically interconnect and align the two core members. The head and shank cores each includes concave side wall sections terminating at the face surfaces to produce cast protrusions in the hollow section of the coupler shank at the parting line between the core members.

11 Claims, 10 Drawing Figures

CORE ASSEMBLY IN A COUPLER FOR A RAILWAY VEHICLE

BACKGROUND OF THE INVENTION

This invention relates to a core assembly for use in a sand mold to cast a hollow section in a coupler head extending continuously beyond a horn line at the rear of the coupler head into a coupler shank. More particularly, the present invention relates to such a core assembly having mating surfaces along a parting line with interfitting projections including a conical projection receivable in a conical recess for maintaining the core sections in a desired position and aligned relation for producing a coupler casting having various combinations of coupler head configurations with coupler shank configurations.

As is known in the art, it is the usual practice to produce a core member in a core box to define, when placed in a sand mold, a hollowed section in a coupler for a railway vehicle. The hollow section extends from the coupler shank continuously into the head portion of the coupler. A secondary core element is used to produce an opening at the rear of the shank for a pin or key to connect the coupler casting to a yoke. A different core box is used to make the cores for casting various different coupler combinations. Thus, for example, different core boxes are required to cast an E-coupler, an E/F coupler and an F-coupler. The number of core boxes is increased because in each type of coupler, different shank designs and different shank lengths must be supplied to meet existing requirements. Therefore, a relatively large number of core boxes is required to meet the needs for a multiplicity of coupler combinations with a required length shank. Dimensional consistency of the core designs at any given transverse section has not been achieved principally because there was no need to maintain a consistent dimensional core cross section. The transverse dimensions of the shank core are usually a result of the need to maintain a minimum shank wall thickness at the hollowed-out portion provided by the core. Since individual core boxes were used to form the main core for the casting, it was immaterial whether the cross-sectional dimensions in the shank core were identical for all coupler cores.

With the foregoing in mind and the ever-present problem of reducing or at least maintaining the cost of couplers for railway vehicles within acceptable limits, it has been discovered that measures can be taken to reduce the cost of manufacturing the core used in a sand mold for casting the coupler. The present invention is based on the discovery that the primary or principal core used for casting a coupler for a railway vehicle is divided into two parts along a plane parallel with and spaced rearwardly of the head core section by a relatively small distance from a plane containing the horn line. Interchangeability of head core sections with shank core sections is assured for virtually all combinations of head and shank designs including shank length requirements by providing consistent and uniform transverse dimensions and edge profiles at the parting line between all core sections.

SUMMARY OF THE INVENTION

It is, therefore, an object of the present invention to provide head and shank core members having end faces with interlocking surfaces to maintain the core members in an abutting relation in a sand mold for casting a hollow section in a coupler head extending continuously beyond the horn line at the rear of the coupler head into the coupler shank.

It is a further object of the present invention to provide head and shank core members adapted for abutting together within a plane wherein corresponding transverse dimensions and edge profiles are consistent throughout all head and shank core members used in any desired interchangeable manner to produce a coupler with a desired head configuration and a desired shank configuration including a desired length to the coupler shank.

The invention resides in the provision of a core assembly including head and shank core members having face surfaces each including a recess surface and a projected surface arranged such that the recess surface in the head core receives the projected surface in the shank core and the recess surface in the shank core receives the projected surface in the head core to maintain the head and shank cores in an aligned abutting relation while supported in a sand mold for casting the coupler, the face surfaces extending transversely to the coupler shank along a parting line in the coupler shank spaced rearwardly of a plane containing the horn line of the coupler head.

In the preferred form of the present invention, the face surfaces of the head and shank core members are defined by substantially identical edge profiles to form smooth side surfaces after the cores are placed in abutting end-to-end relation. The head and shank cores each includes at least one but typically three side walls with concave sections terminating at the aforesaid face surfaces to provide a cast protrusion in the hollowed section of the coupler shank at the parting line of the core members. The cast protrusion or protrusions which are thus formed are blended by the side wall contours of the core members by extending rearwardly and forwardly of the core parting line to provide a coupler having increased strength in a critical high stress area adjacent the horn line. One of the aforesaid face surfaces of the head and shank core members is preferably provided with a cylindrical projection to extend into an annular opening in the remaining one of the face surfaces for mechanically interlocking the head and shank core members. The cylindrical projection and annular recess preferably have a truncated conical shape to provide an indexing alignment between the core members.

The core assembly according to the present invention specifically provides that a head core member defining the internal surface profiles of an E-type coupler head is used in combination with a shank core defining internal surface profiles forming an F-type coupler shank or an E-type coupler shank. In a similar way, a head core member defining internal surface profiles to form an F-type coupler head is useful with a shank core member defining internal surface profiles of an E-type coupler shank or an F-type coupler shank.

These features and advantages of the present invention as well as others will be more fully understood when the following description is read in light of the accompanying drawings, in which.

Figure 2:
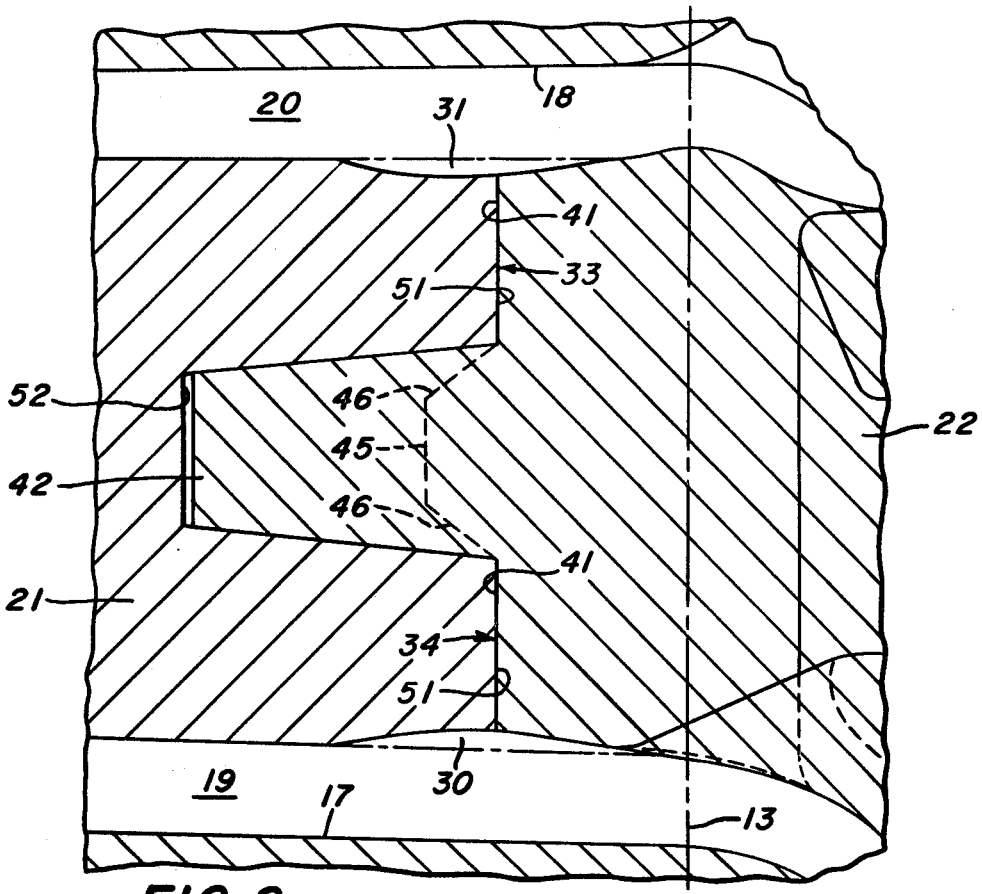
FIG. 2 is a plan view, in section, taken along the parting line between cope and drag mold sections to illustrate the core member shown in FIG. 1.
Figure 1:
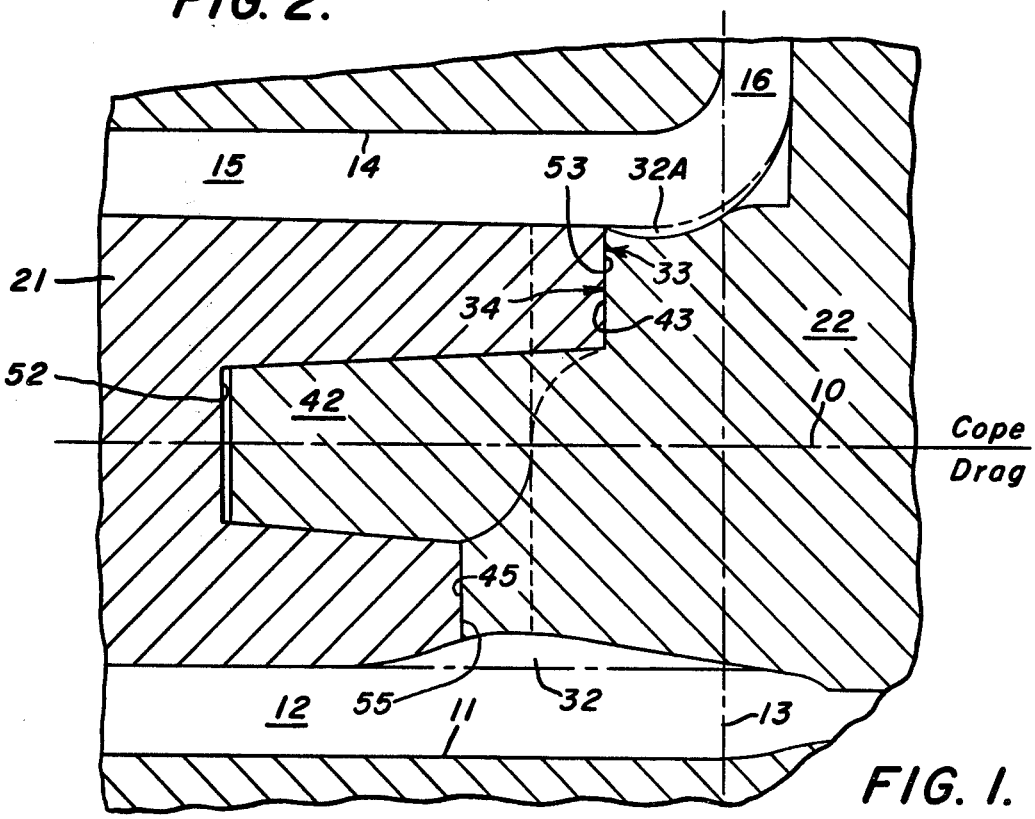
FIG. 1 is a fragmentary elevational view, in section, taken through the center line of a core assembly to illustrate the core construction at the dividing line between core sections according to the present invention.
Figure 9:
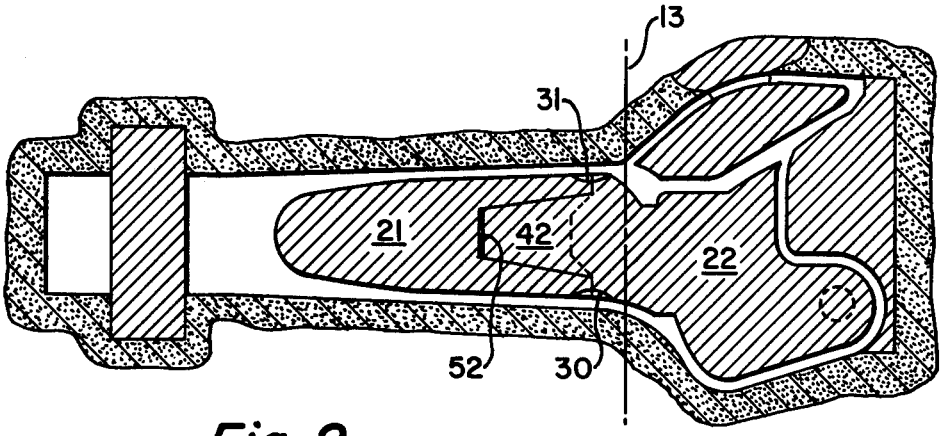
FIG. 9 is a plan view taken along the parting line between the cope and drag mold sections illustrating core members set in a drag mold for an E-type coupler casting.
Figure 10:
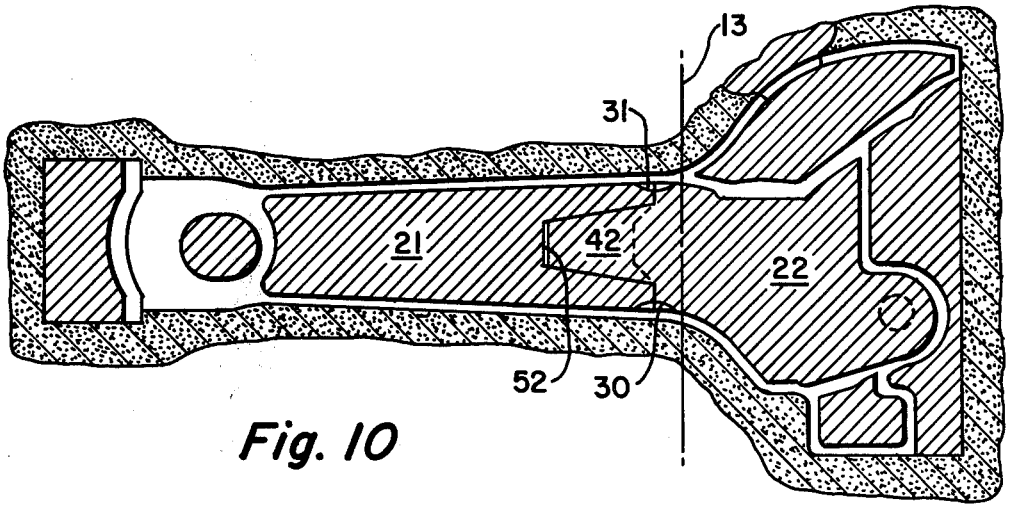
FIG. 10 is a plan view taken along the parting line between the cope and drag mold sections illustrating core members set in a drag mold for an F-type coupler casting.

All surface configurations formed on core members to cast the hollowed-out portions in E-type, E/F-type and F-type couplers are not shown in the drawings because they conform to AAR Standards and are well known in the art. However, some predominant features of these type of couplers are apparent from FIGS. 9 and 10 wherein the open spaces between molded sand and core parts define walls in the coupler castings. The standard forms of couplers include in the casting a horizontal key slot in the shank of an E-type coupler (FIG. 9), a vertical pinhole in the shank of an F-type coupler and interlocking lugs and aligning wing pockets on F-type coupler heads (FIG. 10). The interlocked feature of F-type coupler heads is absent from E-type coupler heads. In FIG. 1, the cope and drag portions of a sand mold for casting an E-type coupler are denoted by a parting line 10 between the mold members. As shown in FIGS. 1, 2 and 9, the sand in the drag portion of the mold is shaped by a pattern to define a surface 11 which is the outer surface of the bottom shank wall 12 of the coupler casting. Surface 11 extends beyond the horn line 13 which is the usual demarcation line between the head and shank portions of a coupler. Sand in the cope portion of the mold is formed by a pattern to define a surface 14 used to form the top wall 15 of the coupler shank. The top wall 15 extends to an upwardly-extending wall portion 16, the outer surface of which defines the horn line 13. FIG. 2 illustrates molded sand in the drag portion of the mold forming surfaces 17 and 18 used to define the outer surface of opposed side walls 19 and 20 in the shank portion of the coupler. Those skilled in the art will recognize the diverging nature of the walls 19 and 20 beyond the horn line indicative of the walls in the coupler head.

Pursuant to the present invention as shown in FIGS. 1, 2, 9 and 10, a core assembly is used in the coupler head to form a hollow section which extends continuously beyond the horn line 13 at the rear wall of the coupler head and into the coupler shank. This assembly includes a shank core member 21 and a head core member 22. If desired, the head core member 22 may consist of an assembly of head core parts. The shank core member 21 has an end face surface which is identical for all shank core lengths and configurations. This identity includes the peripheral edge profile and dimensions both transverse and vertical at the end face surface. The face surface profile of the head core member 22 has a peripheral edge profile and dimensions both transverse and vertical which are identical with the profile and dimensions of the shank core so that when any shank core member and any head core member are abutted in a face-to-face relation, the side walls at the parting line between adjoined core members are substantially smooth. The casting formed by the continuous side walls define at least one but typically three or even four protrusions within the hollowed-out area in the shank. Protrusions on the inside surfaces opposite the side walls, as shown in FIGS. 2, 9 and 10, are denoted by reference numerals 30 and 31 and protrusions from the inside surfaces of the bottom and top walls (as shown in FIG. 1) are denoted by reference numerals 32 and 32A. Depending upon the transverse and vertical dimensions to the hollowed-out section for a given coupler and shank combination, a protrusion may also be formed to the top wall 15. These protrusions, while assuring uniform dimensional characteristics at the parting line between head and shank core members, produce a strengthening to the casting at high stress areas at 30, 31, 32 and 32A because the protrusions are blended forwardly toward the horn line and rearwardly along the coupler shank into the usual wall thicknesses of the casting. This high stress area is one of numerous areas in a coupler for a railway vehicle requiring special attention in regard to strength and fatigue properties.

In the preferred form of the present invention, the parting line between the head and shank core members is spaced about 2 inches along the shank from the horn line 13. The actual configuration of the face surfaces formed on the ends of the shank core member 21 and head core member 22 will be described in greater detail hereinafter in regard to FIGS. 3–8. The core members are formed in core boxes provided with the desired configurations. The core members are produced by conventional methods for making foundry cores. These methods include the so-called hot-box method and the so-called cold-box method. The hot-box method is carried out by providing a mixture of sand and a liquid thermal hardening resin. Under the influence of heat at a temperature of between 100° C. and 300° C., for example, the hardening process of the core sand mixture is effected. According to the $CO_2$ method, foundry sand is mixed with a silicate and after the mixture is placed in a core box, the mixture is hardened by the passage of carbon dioxide. Another cold-box method involves adding to foundry sand a resin which can be polymerized by the action of a catalyst. When this mixture is introduced into the molding cavity, a gas such as carbon dioxide to which a catalyst has been added is injected into the sand mixture causing rapid hardening of the polymerizable resin. In either method, the cores are made by hand or by various types of core machines. Core blowers are typically used.

For the purpose of describing this invention, a core box is a cavity which provides surfaces against which foundry core sand is formed so that after the curing and hardening process, the core is removed, finished and set into a sand mold to form the cast internal shapes. The surfaces of the core box typically define the desired core surface contours that are formed within the casting when the core is removed during clean-out operations. However, in accordance with the present invention, the core boxes used to form the shank core member 21 and head core member 22 also produce end face surfaces 33 and 34, respectively, on the core members which are abutted together in an interlocking relation. The surfaces 33 and 34 do not form surface contours in the casting.

Figure 4:
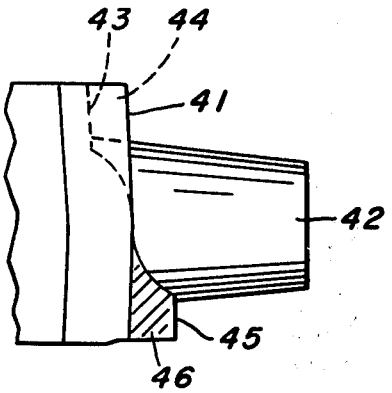
FIG. 4 is a sectional view taken along line IV—IV of FIG. 3.
Figure 3:
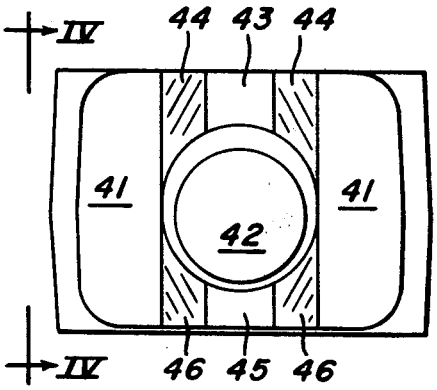
FIG. 3 is an end elevational view of the core end face surface for an E-head coupling member.
Figure 8:
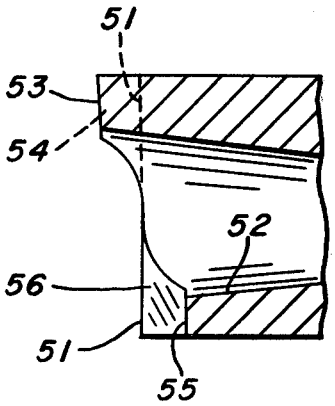
FIG. 8 is a sectional view taken along line VIII—VIII of FIG. 7.

FIGS. 3–6 illustrate two different face surface configurations for a head core member. The face surface configurations shown in FIGS. 3 and 4 are preferred to form the end face surface on a head core section for an E-type coupler. This face surface configuration is shown also in FIGS. 1 and 2 in conjunction with the end surface configuration for an E-type shank core which is also shown in FIGS. 7 and 8 and used on all shank core members. The face surface 34 for an E-type coupler head core includes laterally-spaced side surfaces 41 coextensive with the parting line between core members. A truncated cone 42 projects outwardly from the face surfaces 41 at a central location such that surfaces 41 are situated at the sides of the truncated cone. A recess surface 43 is located above the truncated cone 42. Inclined surfaces 44 at an angle of 45°, when viewed from the top surface of the core, form transitional surfaces between surfaces 41 and surface 43. Below the cone 42, a projected surface 45 is joined by inclined transition surfaces 46 at an angle of, for example, 45° when view from the top of the core member. Surfaces 46 project from surfaces 41 to surface 45.

The shank core member, as shown in FIGS. 7 and 8, has an end face with surfaces for mating engagement with those surfaces just described in regard to the head core member. The end face surfaces of the shank core include laterally-spaced side surfaces 51 between which a truncated recess 52 extends into the body of the shank core member. Above the truncated recess 52, a projected face surface 53 is joined by inclined transitional surfaces 54 with the side surfaces 51. Below the truncated recess 52, a recess surface 55 is joined by inclined transitional surfaces 56 with the side surfaces 51. The interfitting relation of the truncated cone 42 in the conical recess 52 provides a mechanical interlock between the core sections used to index accurately-aligned core sections with respect to one another. An additional interlocking relation between the core members is provided by the interfitting relation of projected surface 53 on the shank core into the recess surface 43 on the head core and the projected surface 45 on the head core into the recess surface 55 on the shank core.

Figure 6:
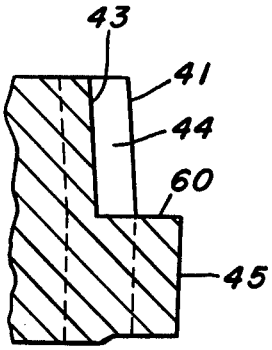
FIG. 6 is a sectional view taken along line VI—VI of FIG. 5.
Figure 5:
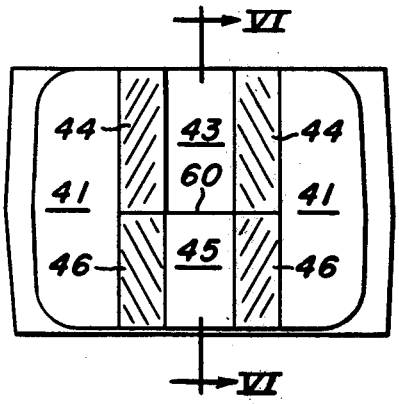
FIG. 5 is a view similar to FIG. 3 but illustrating an F-head coupling member.
Figure 7:
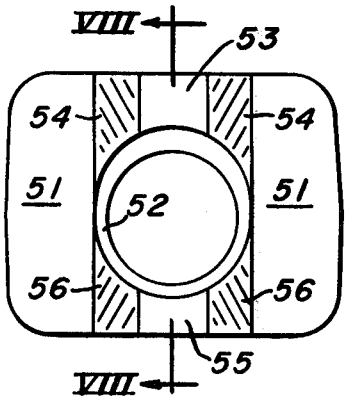
FIG. 7 is an end elevational view illustrating the core end face surface of a shank member.

A modified form of an end face surface for a head core member is shown in FIGS. 5 and 6 which is preferably used according to the present invention on the end face surface of a core member used to form an F-type coupler head. In this regard, the embodiment of FIGS. 5 and 6 differ from that already described in regard to FIGS. 3 and 4 by eliminating the truncated cone 42 whereby a horizontal ledge 60 extends from the lower projected surface 45 to the upper recess surface 43. When a head core having an end face surface as shown in FIGS. 5 and 6 is adjoined with a shank core having an end face surface as shown in FIGS. 7 and 8, the truncated conical recess 52 in the shank core face surface plays no role in the interlocking function and merely accommodates the horizontal ledge 60 between the recess surface 43 at the upper portion of the head core member and projected surface 45 at the lower portion thereof. The interlocking function, however, is still achieved as before because the inclined surfaces 44 and 46 of the head core member perform an aligning function with inclined surfaces 54 and 56 of the shank core member. This aligning function assures that surface 53 abuts against surface 43, surface 55 abuts against surface 45 and surfaces 41 abut against surfaces 51.

Although the invention has been shown in connection with a certain specific embodiment, it will be readily apparent to those skilled in the art that various changes in form and arrangement of parts may be made to suit requirements without departing from the spirit and scope of the invention.

What is claimed is:

1. A core assembly for use in a sand mold for casting a hollow section in a coupler head of a coupler for a railway vehicle, said coupler head extending continuously beyond a horn line at the rear of the coupler head into a coupler shank of the casting, said core assembly including head and shank core members having face surfaces each including a recessed surface and a projected surface arranged such that the recessed surface in the head core receives the projected surface in the shank core and the recessed surface in the shank core receives the projected surface in the head core to maintain the head and shank cores in an aligned abutting relation while supported in a sand mold for casting the coupler, said face surfaces of the head and shank core members extending transverse of the coupler shank along a parting line spaced rearwardly of a plane containing the horn line of the coupler head.

2. The core assembly according to claim 1 wherein said face surfaces of the head and shank core members are defined by substantially identical edge profiles to form smooth side surfaces after the cores are abutted together.

3. The core assembly according to claim 1 wherein said head and shank cores each includes concave side wall sections terminating at said face surfaces to produce a cast protrusion in the hollow section of the coupler shank at said parting line of the core members and thereby to increase the cross-sectional areas of the walls at coupler areas subject to high service stresses.

4. The core assembly according to claim 1 wherein said head and shank cores each includes opposed side walls with concave sections terminating at said face surfaces to produce cast protrusions in the hollow section of the coupler shank at said parting line of the core members.

5. The core assembly according to claim 1 wherein one of said face surfaces includes a cylindrical projection received in a complementary opening in the other face surface for mechanically interlocking said head and shank core members.

6. The core assembly according to claim 5 wherein said cylindrical projection and complementary opening are conically shaped.

7. The core assembly according to claim 1 wherein said head core defines internal surface profiles to form an E-type coupler head, and said shank core assembly defines internal surface profiles to form an F-type coupler shank.

8. The core assembly according to claim 1 wherein said head core defines internal surface profiles to form an F-type coupler head, and said shank core assembly defines internal surface profiles to form an E-type coupler shank.

9. The core assembly according to claim 1 wherein said head core defines internal surface profiles to form an F-type coupler head, and said shank core assembly defines internal surface profiles to form an F-type coupler shank.

10. A core assembly for use in a sand mold for casting a hollow section in a coupler head of a coupler for a railway vehicle, said coupler head extending continuously beyond a horn line at the rear of the coupler head into a coupler shank of the casting, said core assembly including head and shank core members having face surfaces including a recessed surface and a projected surface arranged such that the recessed surface receives the projected surface to maintain the head and shank cores in an aligned abutting relation while supported in a sand mold for casting the coupler, said face surfaces of the head and shank core members extending transverse of the coupler shank along a parting line spaced rearwardly of a plane containing the horn line of the coupler head.

11. The core assembly according to claim 10 wherein said head and shank cores each includes concave side wall sections terminating at said face surfaces to produce a cast protrusion in the hollow section of the coupler shank at said parting line of the core members and thereby to increase the cross-sectional areas of the walls at coupler areas subject to high service stresses.

* * * * *